US008912470B2

(12) United States Patent
Bauer et al.

(10) Patent No.: US 8,912,470 B2
(45) Date of Patent: Dec. 16, 2014

(54) METHOD AND DEVICE FOR CONTROLLING A GLOW PLUG

(75) Inventors: Hans-Peter Bauer, Ditzingen (DE); Rainer Moritz, Filderstadt (DE); Wolfgang Dressler, Vaihingen (DE)

(73) Assignee: Robert Bosch GmbH, Stuttgart (DE)

( * ) Notice: Subject to any disclaimer, the term of this patent is extended or adjusted under 35 U.S.C. 154(b) by 1294 days.

(21) Appl. No.: 12/496,297

(22) Filed: Jul. 1, 2009

(65) Prior Publication Data

US 2011/0000901 A1 Jan. 6, 2011

(51) Int. Cl.

| | |
|---|---|
| ***H05B 1/02*** | (2006.01) |
| ***F02P 19/02*** | (2006.01) |
| ***F23Q 7/00*** | (2006.01) |
| *F02P 17/12* | (2006.01) |

(52) U.S. Cl.

CPC ..... *F02P 19/027* (2013.01); *F02D 2200/0414* (2013.01); *F02P 19/025* (2013.01); *F23Q 7/001* (2013.01); *F02P 17/12* (2013.01)

USPC ..... 219/497; 73/114.62

(58) Field of Classification Search

USPC ..... 219/270, 492, 494; 123/143 R, 145 A, 123/179.6, 179.21; 73/114.62

See application file for complete search history.

(56) References Cited

U.S. PATENT DOCUMENTS

| | | | | |
|---|---|---|---|---|
| 4,499,787 | A | 2/1985 | Leistner et al. | |
| 4,939,347 | A | 7/1990 | Masaka et al. | |
| 5,144,922 | A | 9/1992 | Kong | |
| 2005/0081812 | A1 | 4/2005 | Toedter et al. | |
| 2009/0037120 | A1 * | 2/2009 | Hiramatsu | 702/34 |

FOREIGN PATENT DOCUMENTS

| | | |
|---|---|---|
| DE | 102006010083 | 6/2007 |
| EP | 0064763 | 11/1982 |
| EP | 1 162 368 | 12/2001 |
| JP | 9088795 | 3/1997 |
| WO | WO 2007/140922 | 12/2007 |

* cited by examiner

*Primary Examiner* — Brian Jennison

(74) *Attorney, Agent, or Firm* — Kenyon & Kenyon LLP

(57) ABSTRACT

A method and a device for controlling a glow plug in a combustion engine, where a state of aging A of the glow plug is ascertained, and the control of the glow plug is influenced as a function of the state of aging A of the plug.

23 Claims, 2 Drawing Sheets

METHOD AND DEVICE FOR CONTROLLING A GLOW PLUG

FIELD OF THE INVENTION

The present invention relates to a method and a device for controlling a glow plug.

BACKGROUND INFORMATION

From the European Patent Application EP 64763 A1, a method for controlling a glow plug is discussed, which provides for measuring the current flowing through the glow plug. To this end, a measuring resistor is configured in the current path of the glow plug, and the voltage drop across the measuring resistor is measured. In this manner, variations in the current flowing through the glow plug can be detected.

SUMMARY OF THE INVENTION

In contrast, the advantage of the method according to the present invention, respectively of the device according to the present invention having the features of the independent claims is that a state of aging of the glow plug is recognized and compensated. Thus, the glow plugs may be operated very reliably until the end of their service life, without thereby degrading their functioning, in particular, without adversely affecting a starting of a combustion engine. The operational reliability of a motor vehicle in which such a combustion engine is installed, is thereby improved.

Further advantages and improvements are derived from the features further described herein. The glow plug is controlled in accordance with the exemplary embodiments and/or exemplary methods of the present invention in an especially simple process by increasing the plug voltage that is used to control the same. The state of aging may be ascertained very readily by counting the glow phases, the duration thereof, and by recording the glow temperatures associated therewith or the heating gradients of the plug. A weighting factor, which may be a function of the maximum temperature, the maximum control voltage, the temperature gradient, the control voltage gradient, or the duration of the individual glow phases, may be used to weight the individual glow phases. The aging of the glow plug may be determined very reliably when these measures are applied.

The aging of the glow plug has a pronounced effect when a starting operation takes place at a low ambient temperature of the combustion engine. Accordingly, the aged plug is advantageously controlled as a function of the ambient temperature. In this context, an especially low ambient temperature within a range below 0° requires that the aged plug be controlled in a modified process. The plugs also differ in terms of their aging characteristics, which may be determined by measuring the resistance thereof. For that reason, the control should not only consider the measured resistance of the plug, but also compare this measured resistance with a comparison value.

Exemplary embodiments of the present invention are illustrated in the drawing and explained in greater detail in the following description.

DETAILED DESCRIPTION

Figure 1:
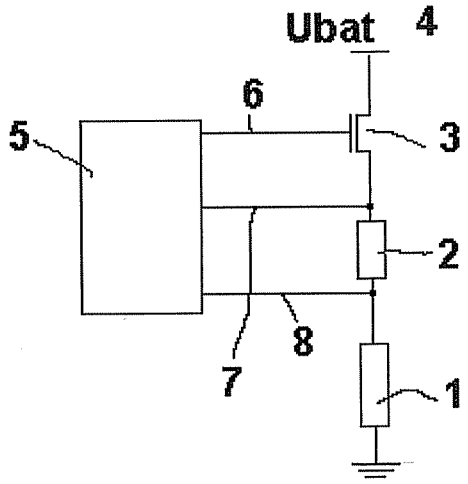
FIG. 1 shows a basic circuit configuration for controlling a glow plug.

FIG. 1 schematically illustrates a glow plug 1 that is connected via a measuring resistor 2 and a MOSFET transistor 3 to a battery voltage U4. Alternatively to MOSFET transistor 3, other power semiconductors or electromechanical switches may also be used. The other connection of glow plug 1 is connected to ground. MOSFET-Transistor 3 is connected on the one side to the battery voltage and, via another connection, to measuring resistor 2. MOSFET transistor 3 is controlled by a glow-time controller 5 which controls a gate terminal of the MOSFET transistor by way of a control line 6. Glow-time controller 5 is able to switch a current flow through MOSFET-Transistor 3 between battery voltage 4 and measuring resistor 2 using control signals to this effect over control line 6. Connected between MOSFET transistor 3 and measuring resistor 2 is a measuring line 7 that is connected to glow-time controller 5. Connected between the other connection of measuring resistor 2 and glow plug 1 is another measuring line 8 that is likewise connected to glow-time controller 5.

Glow-time controller 5 conductively connects MOSFET 3 using signals to this effect over line 6, thereby allowing current to flow from voltage supply 4 through measuring resistor 2 and, on an individual basis, through the glow plug to ground. This current flow heats glow plug 1 to a temperature of over 1000° C., thereby shortening the ignition delay of self-ignition engines. This ensures a start of the Diesel engine in a cold-start condition, and its cold idling, in particular in the case of low-compression engines (compression lower than 16), is greatly improved in terms of engine smoothness and responsiveness. To control glow plug 1, controller 5 notches up MOSFET 3 until a predefined voltage U is present at measuring line 7. This voltage U is selected so as to ensure that a current I of sufficient magnitude flows through glow plug 1 in order to adequately heat glow plug 1. Since the resistance of glow plug 1 changes in response to increased heating, current flow I through plug 1 also changes as a function of the heating of glow plug 1. Given a continuously controlled glow plug 1, the magnitude of voltage U is selected to allow a high enough operating temperature of glow plug 1 to be reached, however, without overtaxing the same. Proper voltage U is selected by adapting glow control 5 to the specific type of glow plug 1.

It has been shown that glow plugs age over the course of time, so that the resistance of glow plug 1 changes. The relationship between aging A of a glow plug and resistance R thereof are schematically shown in a diagram in FIG. 2. Aging A may be determined using various methods. The number of glow phases constitutes an especially simple measure of the aging of a glow plug 1. Glow phases are understood here to signify any control of a glow plug, as is carried out, for example, at a start of the combustion engine or also during operation of the engine in response to too great of a drop in the engine temperature. An especially simple measure provides for a counter to be incremented each time a glow plug is activated and for the counter value in question to then represent a measure of the aging. This measure forms the basis of FIG. 2, where 1000, 2000, 3000, 4000 and 5000 glow phases are represented as a measure of aging A. However, more complicated definitions of the concept of glow plug aging may likewise be used as a basis.

Figure 2:
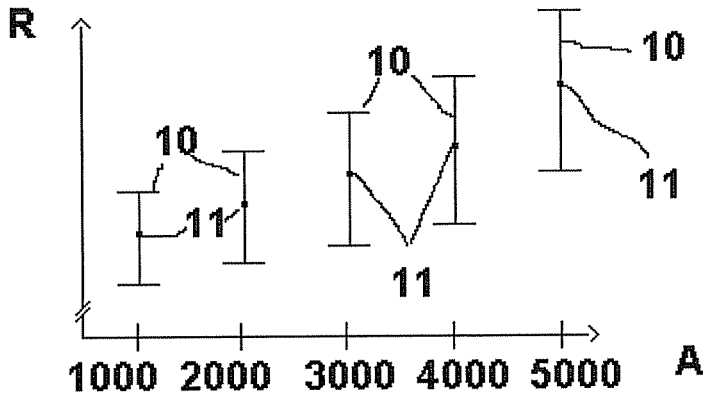
FIG. 2 shows the dependency of the resistance on the aging.

To this end, the individual glow phase is once again multiplied by a weighting factor indicating the extent of the load during this glow phase. For example, the aging may be indicated by once again multiplying by a factor for every glow phase as a function of the maximally occurring glow voltage, which is synonymous with a maximum temperature of the glow plug. Such a definition of the aging state is especially useful when glow-time controller 5 controls MOSFET transistor 3 differently depending on the operating conditions of the combustion engine and implements different levels of control voltages U for the glow plug. As a result, a glow phase having a high control voltage would then be more heavily weighted, respectively exhibit a more pronounced aging of the glow plug than a glow phase having a lower voltage, respectively a lower maximum temperature. It also turns out that the plugs age as a function of a gradient used for generating voltage U. The greater the gradient used for notching up MOSFET transistor 3, the greater the degree of aging of the plug. In this case, a glow phase would then be a measure of the aging; the influence of the individual glow phase would then also be weighted by the temperature gradient or by the control voltage gradient. In addition, the time duration of the individual glow phases may also be considered in that glow phases of a longer time duration are weighted more heavily than the glow phases of shorter time duration. The resistance of a group of glow plugs is illustrated in FIG. 2 as a function of aging A. In this context, mean value 11 of the resistance is first taken over all glow plugs of the group.

As is discernible in FIG. 2, average resistance 11 of the group of glow plugs increases with progressive aging. A scatter bar 10 of the group of glow plugs is also shown. Given a slight degree of aging, a relatively small scatter bar 10 indicates the spread in the resistance of the plugs around mean value 11. As the glow plugs progressively age, the scatter band of the resistance increases, so that corresponding scatter bar 10 is significantly greater at an aging of 5000, for example, than at an aging of 1000. Thus, with progressive aging, not only does the mean value of the resistance increase, but also the spread of the resistance values of the individual, in principle, substantially identical plugs. These observations concerning the aging of the plugs and the associated increase in the resistance and increase in the spread of the resistance are considered in further refinements of the compensation according to the exemplary embodiments and/or exemplary methods of the present invention.

Figure 3:
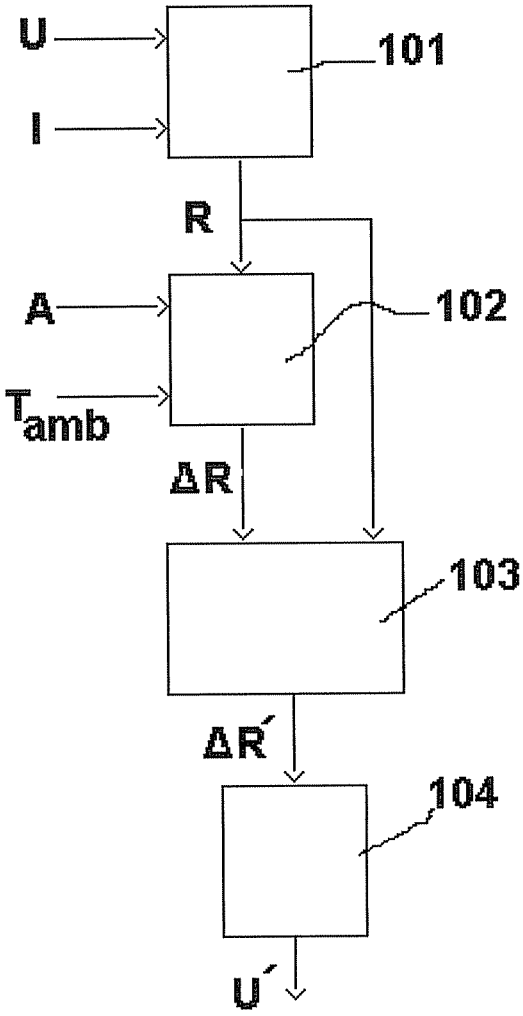
FIG. 3 shows individual method steps for ascertaining the control voltage for the aged glow plug.

FIG. 3 illustrates individual method steps of the method according to the present invention for controlling a glow plug in a combustion engine that make it possible to compensate for the aging of the glow plug. In a first method step 101, the resistance of glow plug 1 is measured in that voltage U and current I are measured, and the resistance of glow plug 1 is calculated therefrom by applying Ohm's law. Voltage U represents the voltage on measuring line 7. The current flowing through glow plug 1 may be determined by the voltage drop across measuring resistor 2, i.e., by comparing the voltages on measuring lines 7 and 8. This value corresponds then to value I which is utilized as the input value for processing step 101. Important in this case is when voltage U and I are measured. The preceding control cycle of the plug provides one option for measuring these values; i.e., the resistance of plug 1 is determined on the basis of U and I of the preceding control.

It is self-evident that this measurement must take place during a static operating state of the plug, i.e., when the plug is heated to a constant operating temperature.

Alternatively, the plug resistance may also be measured at the beginning of the heating phase, for example, either as soon as a voltage U is applied or following a defined time period. In processing step 101, the resistance value is calculated from these measured values for current and voltage and is made available for subsequent processing steps 102, 103. A calculation of a correction value ΔR follows in step 102. Value R of the glow plug calculated in step 101 is used as the input value for these calculations. The aging of glow plug A is used as an additional input variable. An ambient temperature of combustion engine $T_{AMB}$ is also used as an additional input variable. For the corresponding input variables, a characteristic map is provided, which assigns a corresponding output variable ΔR to specific combinations of these input variables. In this connection, it is a question of a three-dimensional characteristic map having dimensions R, A and $T_{AMB}$, which assigns an output variable ΔR to these three input variables. The situation is such that the value for ΔR also increases in response to an increase in R.

In addition, the situation is such that the value for ΔR increases in response to increased aging A. In addition, the value for ΔR increases when ambient temperature $T_{AMB}$ of the combustion engine drops, i.e., at a low temperature of below 0° C., for example, stronger corrective action is taken than at a start of +20° C. In addition, the influence of the correction becomes greater with increased age of the glow plug and with increased resistance R. Alternatively to a characteristic map, it is self-evident that functions may also be stored which assign a corresponding output variable ΔR to these three input variables.

In step 102, the ambient temperature of the combustion engine has a very important and non-linear influence. It turns out, namely, that, at a temperature of +20° C., the aging of the plug has only a very minimal influence on the starting performance of the combustion engine. However, at very low temperatures of, for example, below 0° C. or even of below −10° C., it is very difficult to start a combustion engine having an aged glow plug. Therefore, in this temperature region, it is necessary to take strong corrective action to compensate for the aging of the glow plug. However, since the compensation places heavier demands on the glow plug, and thus the process of aging of the glow plug is even accelerated, it is beneficial to essentially only undertake this compensation when a compensation is expedient due to the degraded starting performance of the combustion engine. Therefore, at normal temperatures of, for example, +20° C., the correction only has a slight influence. The correction likewise has a negligible influence when the glow plug has only aged to an insignificant degree.

The thus calculated correction value ΔR is transmitted from method step 102 as an input quantity to method step 103. Resistance R, which was determined in step 101, is another input quantity for method step 103. A further processing takes place in method step 103 to form the final correction value, the primary concern in this case being protecting the glow plug from being overloaded. To this end, resistance value R and correction value ΔR are initially added, and it is then considered how the thus formed value differs from average value 11, as is known from FIG. 2.

Thus, aging A is considered as an additional input value, and it is checked where the corresponding value lies within scatter band 10. When the thus formed value R+ΔR lies in the lower region of scatter bar 10 (i.e., the plug has only slightly increased its resistance), a substantial correction of the resistance value toward higher resistance values is permitted.

Thus, a substantial correction factor ΔR' is permitted in the case of this plug. When the plug already exhibits a significant change in resistance R+ΔR in the upper region of scatter bar 10, then resistance value R has already undergone a considerable aging-induced change. If, at this point, a very strong corrective action were taken, the plug would also be very quickly subject to further aging, which, in some instances, would lead to a failure of the glow plug in question. For this reason, in the case of a plug that already exhibits significant aging and this aging is accompanied by a significant change in resistance, such a substantial correction is no longer permitted.

It may even be the case that a correction would no longer be made for a plug whose resistance is at the top edge of scatter bar 10. Instead, a degraded starting performance of the combustion engine would be accepted, where necessary. This also possibly serves as an indication to the user of the internal combustion engine that the glow plug should be replaced very soon. Thus, as a result of this weighting, an ΔR' is formed which is made available as an input quantity for next calculation step 104.

In step 104, from plausibility-checked correction value ΔR', a new value is calculated for the control voltage of glow plug 1 that is denoted by U'. This value U' is calculated in that:

$$U'=U+\Delta R'I.$$

Thus, the voltage used for controlling the plug is increased in response to increased aging of the plug, in particular, when the combustion engine is started at low ambient temperatures. In the process, the plausibility check in step 103 ensures that no unnecessarily excessive changes are made, rather that changes are only possible within the limits of typical spread 10 of the resistance values about an average value.

What is claimed is:

1. A method for controlling a glow plug in a combustion engine, the method comprising:

ascertaining, using a controller, a state of aging A of the glow plug; and changing, using the controller, an operational control of the glow plug as a function of the state of aging A of the glow plug, wherein the change in the operational control as a function of the state of aging A of the glow plug is greater at a low ambient temperature than at a high ambient temperature, and wherein the state of aging A of the glow plug is recognized and compensated for by the change in the operational control of the glow plug, so that the glow plug may be operated without adversely affecting a starting of the combustion engine.

2. The method of claim 1, wherein the operational control is carried out as a function of the state of aging A of the glow plug by increasing the plug voltage U that is supplied to the glow plug for heating of the same.

3. The method of claim 1, wherein the state of aging A is co-determined by a number of glow phases.

4. The method of claim 3, wherein individual ones of the glow phases are weighted as a function of one of an occurring maximum temperature and a maximum control voltage.

5. The method of claim 3, wherein the individual glow phases are weighted as a function of one of a gradient of the temperature and a gradient of the control voltage.

6. The method of claim 3, wherein the individual glow phases are weighted as a function of a duration of the individual glow phases.

7. The method of claim 1, wherein an ambient temperature $T_{AMB}$ of the combustion engine is considered in the operational control as a function of the aging state A of the glow plug.

8. The method of claim 1, wherein the operational control of the glow plug as a function of the state of aging depends on a measured resistance of the plug.

9. The method of claim 8, wherein the operational control of the glow plug as a function of the state of aging depends on a mean value of resistance and a spread about the mean value of the resistance for the plug type in question.

10. A device for controlling a glow plug in a combustion engine, comprising:

a processor arrangement to ascertain a state of aging A of the glow plug to change an operational control of the glow plug as a function of the state of aging of the glow plug, wherein a greater change is selected in the control as a function of the state of aging A of the glow plug at a low ambient temperature than at a high ambient temperature, and wherein the state of aging A of the glow plug is recognized and compensated for by the change in the operational control of the glow plug, so that the glow plug may be operated without adversely affecting a starting of the combustion engine.

11. The device of claim 10, wherein the change in the operational control as a function of the state of aging A of the glow plug is greater at a low ambient temperature, in particular within a range below 0° C. than at a high ambient temperature.

12. The device of claim 10, wherein the change in the operational control as a function of the state of aging A of the glow plug is greater at a low ambient temperature, in particular within a range below 0° C. than at a high ambient temperature, in particular above 10° C.

13. The method of claim 1, wherein the change in the operational control as a function of the state of aging A of the glow plug is greater at a low ambient temperature, in particular within a range below 0° C. than at a high ambient temperature.

14. The method of claim 1, wherein the change in the operational control as a function of the state of aging A of the glow plug is greater at a low ambient temperature, in particular within a range below 0° C. than at a high ambient temperature, in particular above 10° C.

15. The method of claim 1, wherein the change in the operational control as a function of the state of aging A of the glow plug is greater at a low ambient temperature than at a high ambient temperature.

16. The method of claim 1, wherein the operational control of the glow plug is changed as a function of the aged state of the glow plug.

17. The device of claim 10, wherein the change in the operational control as a function of the state of aging A of the glow plug is greater at a low ambient temperature than at a high ambient temperature.

18. The device of claim 10, wherein the operational control of the glow plug is changed as a function of the aged state of the glow plug.

19. The device of claim 10, wherein the state of aging A is co-determined by a number of glow phases.

20. The device of claim 19, wherein individual ones of the glow phases are weighted as a function of one of an occurring maximum temperature and a maximum control voltage.

21. The device of claim 19, wherein the individual glow phases are weighted as a function of one of a gradient of the temperature and a gradient of the control voltage.

22. The device of claim 19, wherein the individual glow phases are weighted as a function of a duration of the individual glow phases.

23. The method of claim 1, wherein the low ambient temperature is below 0° C. and the high ambient temperature is above 10° C.

* * * * *